US006102538A

United States Patent [19]

Ochi et al.

[11] Patent Number: 6,102,538

[45] Date of Patent: Aug. 15, 2000

[54] INK JET RECORDING METHOD OF TRANSFERRING AN IMAGE FORMED ON AN INTERMEDIATE TRANSFER ELEMENT ONTO A RECORDING MEDIUM

[75] Inventors: Norihiro Ochi; Hisashi Yoshimura; Hiroshi Onda; Kohji Tsurui; Hajime Horinaka, all of Nara, Japan

[73] Assignee: Sharp Kabushiki Kaisha, Osaka, Japan

[21] Appl. No.: 08/908,977

[22] Filed: Aug. 8, 1997

[30] Foreign Application Priority Data

Aug. 19, 1996 [JP] Japan ..... 8-217028

[51] Int. Cl.[7] ..... B41J 2/01; B41J 2/015

[52] U.S. Cl. ..... 347/103; 347/20

[58] Field of Search ..... 347/103, 20

[56] References Cited

U.S. PATENT DOCUMENTS

| | | | |
|---|---|---|---|
| 4,733,247 | 3/1988 | Arai | 347/20 |
| 4,931,810 | 6/1990 | Iwata et al. | 347/20 X |
| 5,099,256 | 3/1992 | Anderson | 347/103 |
| 5,471,233 | 11/1995 | Okamoto | 347/103 |
| 5,477,249 | 12/1995 | Hotomi | 347/103 X |
| 5,914,739 | 6/1999 | Zhang | 347/71 |

FOREIGN PATENT DOCUMENTS

| | | | |
|---|---|---|---|
| 63-159081 | 7/1988 | Japan | B41M 5/00 |
| 1-148586 | 6/1989 | Japan | B41M 5/00 |
| 3-211057 | 9/1991 | Japan | B41J 2/01 |

*Primary Examiner*—John Barlow
*Assistant Examiner*—Juanita Stephens

[57] ABSTRACT

An ink jet recording method includes the steps of: causing ink drops to fly from a recording head; attaching the ink drops onto an intermediate transfer element at a recording density of no less than 140 dots/cm×140 dots/cm and an amount of ink attached of no more than $3.0\times10^{-4}$ml/cm$^2$; and transferring an image formed on the intermediate transfer element onto a recording medium.

18 Claims, 2 Drawing Sheets

INK JET RECORDING METHOD OF TRANSFERRING AN IMAGE FORMED ON AN INTERMEDIATE TRANSFER ELEMENT ONTO A RECORDING MEDIUM

BACKGROUND OF THE INVENTION

1. Field of the Invention

The present invention relates to an ink jet recording device incorporated in information apparatuses, such as printers, facsimile machines, word processors, and, in particular, to a recording method using an ink jet recording device, of transferring a recorded image formed on an intermediate transfer element onto a recording medium, such as a sheet of paper.

2. Description of the Background Art

Conventional ink-injecting, recording devices are referred to as ink jet, in which ink is attached onto a recording medium, such as a sheet of paper, and recording is thus performed.

In order to obtain a uniform recording density and achieve highly precise recording without feathering in recording in the above manner, the inventions disclosed in Japanese Patent Laying-Open Nos. 63-159081 and 1-148586 define the amount of ink attached. Japanese Patent Laying-Open No. 63-159081 describes the amount of ink attached when a typical ink for ink jet is used for recording, and Japanese Patent Laying-Open No. 1-148586 describes the amount of ink attached when an ink which contains a predetermined amount of a high boiling organic solvent is used for recording.

The both references describe a recording method characterized in that the amount of ink attached in recording at a recording density of 100 dots/cm×100 dots/cm is within a range of $3.0\times10^{-4}$ ml/cm$^2$ to $3.0\times10^{-3}$ ml/cm$^2$.

Furthermore, Japanese Patent Laying-Open No. 3-211057 discloses an invention in which highly precise recording is achieved by defining the physical property and travel velocity of ink and thus optimizing expansion of ink drops and adjusting the shape of dots. It describes a recording method characterized in that the product of the Weber's number (We) and Reynolds number (Re) of a traveling ink drop is no less than one and no more than 300.

Reviewing the disclosures of the references, however, it has been found that these methods are not always advisable for obtaining a clearer edge of a recorded image or improving the precision in impact of ink drops and thus achieving highly precise recording when a recording method other than typical ink jet recording methods, such as recording with a high viscosity ink, an intermediate transfer element and the like, is applied.

For example, the distance between the recording head and the intermediate transfer element can be significantly reduced in an ink jet recording method in which an ink drop injecting portion is used to render ink drops travel and the ink drops are first received by an intermediate transfer element to form an image which is then transferred through pressurization or heating onto a recording medium, such as a sheet of paper. Thus, while the same precision in impact is maintained, travel velocity of ink drops can further be reduced. For the recording methods described in Japanese Patent Laying-Open Nos. 63-159081, 1-148586 and 3-211057, however, when traveling ink drops impact on an intermediate transfer element, which does, unlike paper, not at all absorb ink, the ink is scattered and a uniform shape of dots cannot be obtained.

Furthermore, when a high viscosity ink, such as a general printing ink, is used, for example, time is required until the ink is absorbed into a sheet of paper. Consequently, in transfer through heating or pressurization, the ink does not sufficiently infiltrate into the sheet of paper and the ink will bleed on the sheet of paper, and for the amount of ink attached which is defined in each of the above references, an image becomes thick and highly precise recording cannot be achieved.

In addition, there is a demand for higher resolution in the market from year to year and the optimal amount of ink attached is accordingly considered in an area with extremely high resolution and it has been found that the optimal amount of ink attached is reduced with increase of resolution, and in some cases, highly precise recording cannot be performed in the range of ink adhesion described in each of the above references.

SUMMARY OF THE INVENTION

An object of the present invention is to provide an ink jet recording method capable of highly precise recording with a uniform shape of dots and without bleeding.

In an aspect of the present invention, an ink jet recording method includes the steps of: causing ink drops to fly from a recording head; attaching the ink drops onto an intermediate transfer element at a recording density of no less than 140 dots/cm×140 dots/cm with an amount of ink attached being no more than $3.0\times10^{-4}$ ml/cm$^2$; and transferring an image formed on the intermediate transfer element onto a recording medium.

Since the recording density is no less than 140 dots/cm× 140 dots/cm and the amount of ink attached is no more than $3.0\times10^{-4}$ ml/cm$^2$, the amount of ink attached onto the intermediate transfer element is optimized and highly precise recording can thus be achieved in which bleeding is not caused, a uniform shape of dots is obtained and the recording density is optimized.

In another aspect of the present invention, an ink jet recording method includes the steps of: causing ink drops to fly from a recording head; attaching the ink drops onto an intermediate transfer element; and transferring an image formed on the intermediate transfer element onto a recording medium at a recording density of no less than 140 dots/cm× 140 dots/cm with an amount being ink attached being no more than $3.0\times10^{-4}$ ml/cm$^2$.

Since the recording density is no less than 140 dots/cm× 140 dots/cm and the amount of ink attached is no more than $3.0\times10^{-4}$ ml/cm$^2$, the amount of ink attached onto the recording medium is optimized and highly precise recording can thus be achieved in which bleeding is not caused, a uniform shape of dots is obtained and the recording density is optimized.

The foregoing and other objects, features, aspects and advantages of the present invention will become more apparent from the following detailed description of the present invention when taken in conjunction with the accompanying drawings.

DESCRIPTION OF THE PREFERRED EMBODIMENTS

Embodiments of an ink jet recording method according to the present invention will now be described.

Figure 1:
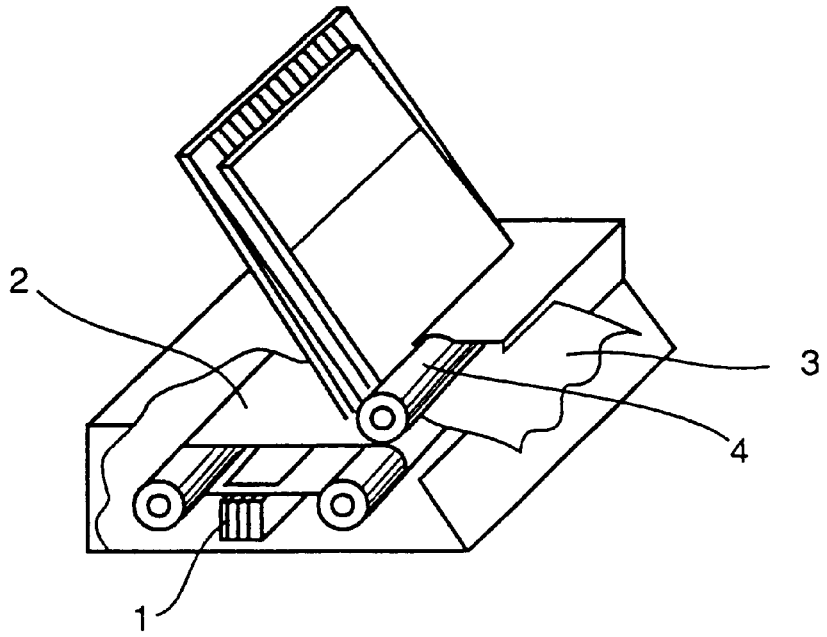
FIG. 1 is a schematic perspective view of an ink jet recording device in its entirety to which an ink jet recording method according to the present invention is applied.

Referring to FIG. 1, an ink jet recording device includes a recording head 1 for injecting ink, an intermediate transfer element 2, a recording sheet 3 and a transfer roller 4. While intermediate transfer element 2 in the present invention is a belt, it may be a drum.

The steps taken until an image is formed on recording sheet 3 will now be described with reference to FIG. 2. A periphery of the recording head includes a transfer supplementing portion 6 which performs heating or ultraviolet radiation beforehand so as to readily transfer an recorded image formed on intermediate transfer element 2, and a cleaning blade 7 for cleaning the remaining ink which has not been transferred onto recording sheet 3. The letters Y, M, C and B indicated on recording head 1 indicate a plurality of recording heads Y (Yellow), a plurality of recording heads M (Magenta), a plurality of recording heads C (Cyan) and a plurality of recording heads B (Black), respectively.

Figure 2:
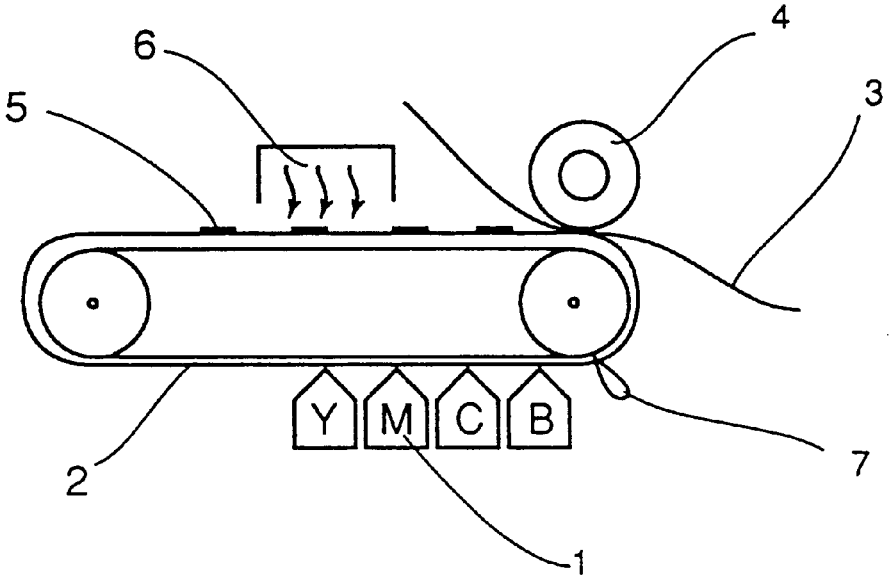
FIG. 2 is a schematic cross sectional view of a periphery of the recording head of the ink jet recording device shown in FIG. 1.

In FIG. 2, the ink injected by recording head 1 according to image information is recorded on intermediate transfer element 2 and the recorded image 5 is then transported to transfer supplementing portion 6 by clockwise, rotational movement of intermediate transfer element 2.

Then, recorded image 5 is fixed by transfer roller 4 onto recording sheet 3 through heating or pressurization. The ink which has not been transferred and thus remains on intermediate transfer element 2 is then removed by cleaning blade 7, and intermediate transfer element 2 is again transported to a position at which intermediate transfer element 2 receives ink from recording head 1.

Figure 3:
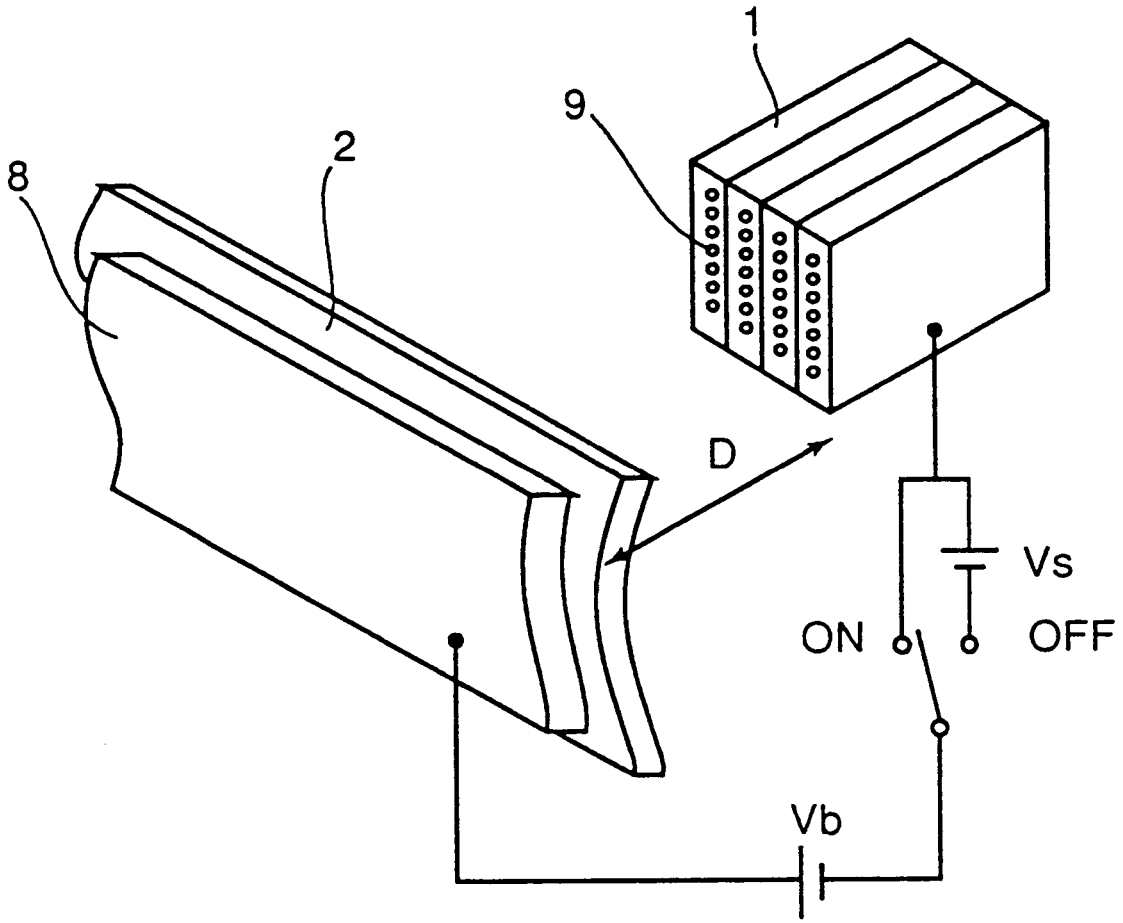
FIG. 3 is a schematic perspective view for illustrating an operation of the recording head of the ink jet recording device shown in FIG. 1.

Referring to FIG. 3, a recording head used in an ink jet recording method according to the present invention is of so-called electrostatic attraction type. The periphery of the recording head includes an opposing electrode 8 positioned opposite to recording head 1 with intermediate transfer element 2 disposed therebetween. Recording head 1 is provided with a plurality of ink injection openings 9. Although the voltage applied between opposing electrode 8 and recording head 1 is shown connected to recording head 1 in the Figure for convenience' sake, the voltage is selectively applied to each ink emission opening 9.

Furthermore, intermediate transfer element 2 itself can be made of a conducting material so that intermediate transfer element 2 also acts as opposing electrode 8 and opposing electrode 8 may be thus eliminated.

Recording head 1 is spaced apart from intermediate transfer element 2 by a distance D. A bias voltage Vb and a signal voltage Vs are applied between recording head 1 and opposing electrode 8 in recording and non-recording, respectively.

The distance D is preferably no more than 0.2 cm and, if possible, is adapted to be set to no more than 500 $\mu$m.

When the distance D is reduced to as small a value as possible, variation of the direction in which ink is injected is suppressed and deviation of the position at which the ink impacts can thus be suppressed. The suppression of the deviation in the position at which ink impacts is, however, very difficult to achieve for typical ink jet which does not use intermediate transfer element 2.

This is because, for typical ink jet, the recording head is arranged directly opposite to a recording sheet and thus clogging due to paper particles is caused, a difference among deviations in the position of impact is caused due to a difference in thickness of the recording sheet, and the like.

In recording, ink drops are formed by applying voltage between each ink injection opening 9 and opposing electrode 8, as described above, so that electrostatic attraction acts on ink.

It should be noted that the diameter of ink drops formed and the velocity of traveling ink can be changed depending on the magnitude of the voltage applied and the time period during which the voltage is applied.

This is, of course, relevant to the diameter of ink injection opening 9. In the present invention, recording heads having a circular ink injection opening of 400 $\mu$m in inner diameter, a rectangular ink injection opening having a diagonal of 200 $\mu$m, and a rectangular ink injection opening having a diagonal of 50 $\mu$m, respectively, are used to carry out a recording test at recording densities of 140 dots/cm×140 dots/cm to 240 dots/cm×240 dots/cm, 240 dots/cm×240 dots/cm to 400 dots/cm×400 dots/cm, and no less than 400 dots/cm×400 dots/cm.

For the respective ranges of recording density, satisfactory printing results were obtained when their respective amounts of ink attached were in the range of $3.5\times10^{-5}$ ml/cm$^2$ to $3.0\times10^{-4}$ ml/cm$^2$, the range of $2.0\times10^{-5}$ ml/cm$^2$ to $2.7\times10^{-4}$ ml/cm$^2$ and particularly for an area with the recording density of no less than 400 dots/cm×400 dots/cm, the range of 0.03/N (ml/cm$^2$) to 0.09/N (ml/cm$^2$), wherein recording density is represented as N dots/cm, respectively.

Quality of a printing result was determined depending on whether or not the optical density (OD value) in solid printing was no less than one. Visual observation with a microscope was also carried out on bleeding and feathering. Quality of the shape of a dot resulting from spreading of ink was determined depending on whether or not the standard deviation obtained by measuring the diameter of the dot at several points was no more than 0.50. Examples which obtained satisfactory results for all of the decisions were evaluated as good, as shown in Table 1.

TABLE 1

| Recording Density (dot/cm) | Amount of Ink Attached (ml/cm$^2$) | OD Value | Bleeding, Feathering | Round-ness | Evaluation |
|---|---|---|---|---|---|
| 144 × 144 | 3.7 × 10 E − 4 | 1.6 | Not Tolerable | 0.6 | Poor |
| 144 × 144 | 3.0 × 10 E − 4 | 1.5 | Tolerable | 0.5 | Good |
| 144 × 144 | 3.5 × 10 E − 5 | 1.0 | Tolerable | 0.4 | Good |
| 144 × 144 | 3.0 × 10 E − 5 | 0.8 | Tolerable | 0.4 | Poor |
| 248 × 248 | 3.0 × 10 E − 4 | 1.6 | Not Tolerable | 0.5 | Poor |
| 248 × 248 | 2.7 × 10 E − 4 | 1.6 | Tolerable | 0.5 | Good |
| 248 × 248 | 2.0 × 10 E − 5 | 1.0 | Tolerable | 0.3 | Good |
| 248 × 248 | 1.6 × 10 E − 5 | 0.8 | Tolerable | 0.3 | Poor |
| 413 × 413 | 2.2 × 10 E − 4 | 1.6 | Not Tolerable | 0.9 | Poor |
| 413 × 413 | 7.3 × 10 E − 5 | 1.1 | Tolerable | 0.5 | Good |
| 413 × 413 | 3.0 × 10 E − 5 | 0.9 | Tolerable | 0.5 | Poor |
| 560 × 560 | 3.0 × 10 E − 5 | 1.0 | Tolerable | 0.5 | Good |

A second embodiment of the present invention will now be described.

An intermediate transfer element having an outest layer of polyethersulfone was used and the surface thereof was refined by irradiating it with ultraviolet rays having a wavelength of 248 nm.

Three identical intermediate transfer elements were irradiated with ultraviolet rays by zero shot (no shot), 1000 shots and 15000 shots, respectively, at a laser oscillation frequency of 50 Hz, a irradiation time period of 15 nsec/shot and an energy density of 18 mJ/cm$^2$ at the surface to be refined.

As a result, intermediate transfer elements were obtained in which their respective contact angles between ink and a surface of the respective intermediate transfer elements are 110°, 85° and 18°, respectively, and a recording test similar to the first embodiment was carried out using these intermediate transfer elements and an intermediate transfer element having a glass surface a contact angle of which is no more than 10°.

It can be seen from Table 2 that the elements irradiated by 1000 shots and 15000 shots obtained a satisfactory printing result.

TABLE 2

| | Contact Angle (degree) | OD Value | Bleeding, Feathering | Round-ness | Evaluation |
|---|---|---|---|---|---|
| | 110 | 1.6 | Tolerable | 0.6 | Poor |
| | 85 | 1.6 | Tolerable | 0.5 | Good |
| | 18 | 1.5 | Tolerable | 0.4 | Good |
| | 7~9 | 1.5 | Tolerable | 0.7 | Poor |
| Recording Density (dots/cm) | Amount of Ink Attached (ml/cm$^2$) | | | | |
| 248 × 248 | 2.7 × 10 E − 4 | | | | |

The reason is as follows: for a large contact angle, the shape of ink on an intermediate transfer element is nearly spherical after the ink has been impacted on the intermediate transfer element. However, the contact of the ink with a recording sheet in transfer is almost point contact accordingly and thus the ink does not infiltrate into the sheet rapidly and the roundness of dot will vary depending on the material of the sheet. For a small contact angle, spreading of ink varies during transportation on the intermediate transfer element and the roundness of dot will also be degraded.

A third embodiment of the present invention will now be described. A photogravure ink is used in a configuration similar to that of the first embodiment.

An ink was used which contains a pigment of 0%–40%, toluene of 30%–40%, ethyl acetate of 5%–10% and isopropyl alcohol of 10%–20% as a base, which is mixed with a resin mixed with a pigment having the same percentage content as that in the base, and with glycol group to adjust viscosity.

Satisfactory printing results have been obtained for the types of ink of 9.8 cP and 206 cP in viscosity, as shown in Table 3. This is because for a viscosity smaller than a certain value, infiltration of ink into a sheet is readily affected by the material of the sheet, bleeding and feathering are readily caused and the roundness of dot is degraded, whereas for too large a viscosity, ink cannot be supplied to the recording head and what is worse, ink will not be caused to fly.

TABLE 3

| | Viscosity (cP) | OD Value | Bleeding, Feathering | Round-ness | Evaluation |
|---|---|---|---|---|---|
| | 5.6 | 1.6 | Not Tolerable | 0.7 | Poor |
| | 9.8 | 1.6 | Tolerable | 0.5 | Good |
| | 206 | 1.4 | Tolerable | 0.4 | Good |

TABLE 3-continued

| | Paste Hot Melt | No Ink Traveling 1.7 | Tolerable | 0.3 | Good |
|---|---|---|---|---|---|
| Recording Density (dots/cm) | Amount of Ink Attached (ml/cm$^2$) | | | | |
| 248 × 248 | 2.7 × 10 E − 4 | | | | |

Hot melt ink can be used to solve this problem. It is a solid ink at normal temperature and its viscosity can be decreased to several cP when it is heated to 100° C.–170° C. It is necessary in this example that the ink supplying system and recording head 1 be provided with heating means and that the transfer onto recording sheet 3 be performed through heating.

Furthermore, intermediate transfer element 2 need be of a highly heat-resistant material and thus polyetherimide in the shape of belt was used as intermediate transfer element 2 in the present embodiment.

In this example, ink traveling from recording head 1 is liquid having a low viscosity and thus ink drops in a proper shape can be caused to fly with reduced energy. Since the ink drops cake on intermediate transfer element 2, they do not spread too much before they are transported to the transfer position.

When the ink is then liquefied again through heating in transfer and thus recorded on recording sheet 3, the ink comes into contact with recording sheet 3 and thus emits heat and rapidly cakes on recording sheet 3. This, as is not the case with typical liquid ink, allows formation of a dot which is free from bleeding and feathering and thus has high roundness.

A fourth embodiment of the present invention will now be described.

In the fourth embodiment, various types of ink each having a different density, surface tension and viscosity are used in a recording method similar to that of the third embodiment and their respective printing matters were similarly evaluated by measuring the tip velocity (cm/sec) of an ink drop when it impacts on intermediate transfer element 2 and the diameter (cm) of the tip of traveling ink.

The results are shown in Table 4. The unit of each value in the table is the cgs system of units. It is appreciated from the data in the second and third rows in the table that a printing evaluation can be poor for a viscosity of 12.5 cP when the viscosity of ink is within a range of 10 cP to 200 cP in an environment at 25° C. and that a printing evaluation can be good for a viscosity of 9.8 cP when the viscosity of ink is not in the same range. This explains the importance of defining We.Re.

TABLE 4

| ρ | d | υ | γ | η | We · Re | OD Value | Bleeding, Feathering | Round-ness | Evaluation |
|---|---|---|---|---|---|---|---|---|---|
| 1.04 | 0.00203 | 560 | 50.3 | 5.6 | 2.78 | 1.6 | Tolerable | 0.7 | Poor |
| 1.16 | 0.00213 | 545 | 50.1 | 12.5 | 1.58 | 1.5 | Tolerable | 0.6 | Poor |
| 1.02 | 0.00191 | 504 | 51.9 | 9.8 | 0.96 | 1.6 | Tolerable | 0.5 | Good |
| 1.04 | 0.00206 | 544 | 49.8 | 206 | 0.07 | 1.4 | Tolerable | 0.4 | Good |
| 1.04 | 0.00354 | 501 | 50.9 | 36 | 0.93 | 1.6 | Tolerable | 0.4 | Good |
| 1.28 | 0.00114 | 522 | 50.1 | 12.5 | 0.48 | 1.1 | Tolerable | 0.4 | Good |

TABLE 4-continued

| ρ | d | υ | γ | η | We · Re | OD Value | Bleeding, Feathering | Round-ness | Evaluation |
|---|---|---|---|---|---|---|---|---|---|
| 1.03 | 0.00105 | 754 | 49.4 | 36 | 0.28 | 1.0 | Tolerable | 0.5 | Good |
| 1.28 | 0.00264 | 389 | 48.8 | 12.5 | 1.10 | 1.4 | Tolerable | 0.3 | Good |

The data in the second row includes a high ink density and a high ink travel velocity. Thus, even if the other physical and conditional properties, such as viscosity, is optimized, the ink receives a large impact when the traveling ink impacts on intermediate transfer element 2, and thus the ink is readily scattered and a uniform shape of dot cannot be obtained.

Furthermore, it has been found from another view that considering only ink travel velocity regardless of the value of We.Re, a satisfactory printing result is obtained when the velocity is no more than 500 cm/sec.

This comes from the viewpoint that when scattering of ink on intermediate transfer element 2 is considered, the kinetic energy of an ink drop is represented as 0.5 $mv^2$, wherein m represents the mass of the ink drop, and thus velocity has the greatest influence. In an environment where the temperature of ink is 25° C., when the ink has a viscosity in a range of 10 cp–200 cp, its density is limited to 0.85 $g/cm^3$ to 1.35 $g/cm^3$.

Thus, defining only velocity can also lead to a satisfactory printing result. This is indicated by the data in the bottom row of the Table 4.

While this fact related to ink travel velocity applies to conventional ink jet methods, it is difficult due to influences of recording sheet 3 to place recording head 1 extremely close to recording sheet 3 as a recording medium in a typical recording which does not use intermediate transfer element 2, as has been previously described.

Thus, for an ink travel velocity of no more than 500 cm/sec, the position at which ink impacts greatly deviates. Consequently, a satisfactory printing matter cannot be obtained even when dots in proper shape are obtained. Furthermore, a travel velocity as extremely low as no more than 100 cm/sec cannot be implemented due to characteristics of the recording method. Even if it is implemented, the position at which ink impacts is expected to greatly deviate, as is the case with conventional arts, for extremely low travel velocity, and thus the present invention is defined for a travel velocity of no less than 100 cm/sec.

As described hereinbefore, the amount of ink attached on intermediate transfer element 2 or recording sheet 3 is adapted to be in a range of $3.5\times10^{-5}$ $ml/cm^2$ to $3.0\times10^{-4}$ $ml/cm^2$ when recording is performed at a recording density of 140 dots/cm×140 dots/cm to 240 dots/cm×240 dots/cm, the amount of ink attached on intermediate transfer element 2 or recording sheet 3 is adapted to be in a range of $2.0\times10^{-5}$ $ml/cm^2$ to $2.7\times10^{-4}$ $ml/cm^2$ when recording is performed at a recording density of 240 dots/cm×240 dots/cm to 400 dots/cm×400 dots/cm, and the amount of ink attached on intermediate transfer element 2 or recording sheet 3 is adapted to be in a range of 0.03/N($ml/cm^2$) to 0.09/N($ml/cm^2$), wherein recording density is represented as N dots/cm, when recording is performed at a recording density of no less than 400 dots/cm×400 dots/cm. They are defined to record with an appropriate amount of ink without bleeding when the ink is transferred from intermediate transfer element 2 onto recording sheet 3.

Furthermore, when the contact angle between the ink used in recording and a surface of intermediate transfer element 2 is adapted to be 10° to 90° in an environment at 25° C., a uniform shape of ink is obtained in transportation of the ink by intermediate transfer element 2.

Furthermore, the viscosity of ink used for recording is defined to fall within a range of 10 cP to 200 cP in an environment at a temperature of 25° C. so that infiltration of the ink into a recording sheet is limited when the ink is transferred onto the sheet.

Furthermore, recording head 1 used for recording is adapted to be of electrostatic attraction type, and the closest distance between the tip of recording head 1 and an intermediate transfer element which also serves as opposing electrode 8 is adapted to be no more than 0.2 cm.

$$We \cdot Re = \frac{\rho^2 d^2 v^3}{\gamma \cdot \eta} \tag{1}$$

ρ: ink density ($g/cm^2$)

d: diameter of the tip of traveling ink (cm)

v: tip velocity of an ink drop when it impacts on an intermediate transfer element (cm/sec)

γ: surface tension of ink (dyne/cm)

η: ink viscosity (cP)

Furthermore, the product of the Weber's number (We) and Reynolds number (Re) of a traveling ink drop represented as expression (1) can be no more than one to obtain a proper shape of ink drops when the ink impacts on the intermediate transfer element.

Any of these conditions takes into consideration the behavior and infiltration of ink when intermediate transfer element 2 receives traveling ink which is then transferred onto recording sheet 3, and thus are not applicable to typical ink jet methods in which ink drops impact directly on recording sheet 3, since intermediate transfer element 2 is not included therein.

The present invention also promotes use of high viscosity ink which could not be readily achieved by typical so-called ink jet recording methods, such as bubble jet method, in which ink drops are formed by normal change of pressure inside a nozzle. This allows use of ink for printing machines which is highly viscous and yet has a high density, causes less bleeding and is capable of high quality recording, and allows further highly precise recording with various color tones.

Furthermore, when compared with other ink jet methods, the present invention allows formation of an ink drop as extremely fine as several μm and can also reduce the recording energy required for traveling an ink having equivalent physical properties.

Furthermore, when compared with other ink jet methods, the present invention can reduce the distance between the recording head and the recording medium and thus can highly precisely control the position at which ink impacts when the direction in which the ink is injected varies, allowing rapid, highly precise recording. Thus, the present invention can achieve fast and further highly precise recording with low energy, which has not been conventionally achieved.

Furthermore, the optimal travel velocity of ink and the optimal diameter of an ink drop can be set for ink having various physical properties and the ink drop which has impacted on intermediate transfer element 2 is stabilized in a proper shape. Thus, bleeding and feathering caused when ink is transferred before it spreads, degradation in recording density and uneven shape of ink drops due to too much spreading of ink, formation of unnecessary dots due to scattering of ink and the like can be prevented, and further highly precise recording can be achieved.

Furthermore, according to the present invention, defining of only ink travel velocity also stabilizes the shape of an ink drop which has impacted on intermediate transfer element 2 and thus allows further highly precise recording.

Although the present invention has been described and illustrated in detail, it is clearly understood that the same is by way of illustration and example only and is not to be taken by way of limitation, the spirit and scope of the present invention being limited only by the terms of the appended claims.

What is claimed is:

1. An ink jet recording method comprising the steps of:

applying direct voltage between a recording head and an intermediate transfer element;

causing an ink drop to fly from the recording head;

attaching the ink drop onto the intermediate transfer element at a recording density of no less than 140 dots/cm×140 dots/cm and an amount of ink attached of no more than $3.0\times10^{-4}$ ml/cm$^2$; and transferring an image formed on said intermediate transfer element onto a recording medium.

2. The ink jet recording method according to claim 1, wherein in the step of attaching said ink drop onto said intermediate transfer element, a recording density falls within a range of 140 dots/cm×140 dots/cm to 240 dots/cm×240 dots/cm and an amount of ink attached falls within a range of $3.5\times10^{-5}$ ml/cm$^2$ to $3.0\times10^{-4}$ m,/cm$^2$.

3. The ink jet recording method according to claim 1, wherein in the step of attaching said ink drop onto said intermediate transfer element, a recording density falls within a range of 240 dots/cm×240 dots/cm to 400 dots/cm×400 dots/cm and an amount of ink attached falls within a range of $2.0\times10^{-5}$ ml/cm$^2$ to $2.7\times10^{-4}$ml/cm$^2$.

4. The ink jet recording method according to claim 1, wherein in the step of attaching said ink drop onto said intermediate transfer element, a recording density is no less than 400 dots/cm×400 dots/cm and an amount of ink attached falls within a range of 0.03/N ml/cm$^2$ to 0.09/N ml/cm$^2$, wherein a recording density is N dots/cm×N dots/cm.

5. The ink jet recording method according to claim 1, wherein a contact angle between said ink drop and a surface of said intermediate transfer element is 10° to 90° in an environment at a temperature of 25° C.

6. The ink jet recording method according to claim 1, wherein a viscosity of said ink drop falls within a range of 10 cP to 200 cP in an environment at a temperature of 25° C.

7. The ink jet recording method according to claim 6, further comprising the steps of:

setting the closest distance between said recording head and said intermediate transfer element to be no more than 0.2 cm.

8. The ink jet recording method according to claim 6, wherein a product of a Weber's number We and a Reynolds number Re of said traveling ink drop is represented as:

$$We \cdot Re = \frac{\rho^2 d^2 v^3}{\gamma \cdot \eta}$$

is no more than one, wherein ρ g/cm$^3$ represents a density of said ink drop, d cm represents a diameter of a tip of said ink drop, v cm/sec represents a tip velocity when said ink drop impacts on said intermediate transfer element, γ dyne/cm represents a surface tension of said ink drop and η cP represents a viscosity of said ink drop.

9. The ink jet recording method according to claim 7, wherein a tip velocity of said ink drop is 100 cm/sec to 500 cm/sec when said ink drop impacts on said intermediate transfer element.

10. An ink jet recording method comprising the steps of:

applying direct voltage between a recording head and an intermediate transfer element causing an ink drop to fly from the recording head;

attaching said ink drop onto the intermediate transfer element; and transferring an image formed on said intermediate transfer element onto a recording medium at a recording density of no less than 140 dots/cm×140 dots/cm and an amount of ink attached of no more than $3.0\times10^{-4}$ ml/cm$^2$.

11. The ink jet recording method according to claim 10, wherein in the step of transferring an image formed on said intermediate transfer element onto a recording medium, a recording density is 140 dots/cm×140 dots/cm to 240 dots/cm×240 dots/cm and an amount of ink attached falls within a range of $3.5\times10^{-5}$ ml/cm$^2$ to $3.0\times10^{-4}$ ml/cm$^2$.

12. The ink jet recording method according to claim 10, wherein in the step of transferring an image formed on said intermediate transfer element onto a recording medium, a recording density is 240 dots/cm×240 dots/cm to 400 dots/cm×400 dots/cm and an amount of ink attached falls within a range of $2.0\times10^{-5}$ ml/cm$^2$ to $2.7\times10^{-4}$ ml/cm$^2$.

13. The ink jet recording method according to claim 10, wherein in the step of transferring an image formed on said intermediate transfer element onto a recording medium, a recording density is no less than 400 dots/cm×400 dots/cm and an amount of ink attached falls within a range of 0.03/N ml/cm$^2$ to 0.09/N ml/cm$^2$, wherein a recording density is represented as N dots/cm×N dots/cm.

14. The ink jet recording method according to claim 10, wherein a contact angle between said ink drop and a surface of said intermediate transfer element is 10° to 90° in an environment at a temperature of 25° C.

15. The ink jet recording method according to claim 10, wherein a viscosity of said ink drop falls within a range of 10 cP to 200 cP in an environment at a temperature of 25° C.

16. The ink jet recording method according to claim 15, further comprising the steps of:

setting the closest distance between said recording head and said intermediate transfer element to be no more than 0.2 cm.

17. The ink jet recording method according to claim 15, wherein a product of a Weber's number We and a Reynolds number Re of said traveling ink drop represented as:

$$We \cdot Re = \frac{\rho^2 d^2 v^3}{\gamma \cdot \eta}$$

is no more than one, wherein ρ g/cm$^3$ represents a density of said ink drop, d cm represents a diameter of a tip of said ink drop, v cm/sec represents a tip velocity when said ink drop impacts on said intermediate transfer element, γ dyne/cm represents a surface tension of said ink drop and η cP represents a viscosity of said ink drop.

18. The ink jet recording method according to claim 16, wherein a tip velocity of said ink drop is 100 cm/sec to 500 cm/sec when said ink drop impacts on said intermediate transfer element.

* * * * *